US007654125B2

(12) United States Patent
Hammar et al.

(10) Patent No.: US 7,654,125 B2
(45) Date of Patent: Feb. 2, 2010

(54) METAL FORMING APPARATUS

(75) Inventors: Richard H. Hammar, Utica, MI (US); James G. Schroth, Troy, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 48 days.

(21) Appl. No.: 11/671,481

(22) Filed: Feb. 6, 2007

(65) Prior Publication Data

US 2008/0184762 A1 Aug. 7, 2008

(51) Int. Cl.
*B21D 37/16* (2006.01)

(52) U.S. Cl. ..... 72/342.92; 72/342.1

(58) Field of Classification Search ..... 72/342.1, 72/342.7, 342.8, 342.4, 342.92, 60, 57; 219/602
See application file for complete search history.

(56) References Cited

U.S. PATENT DOCUMENTS 5,974,847 A 11/1999 Saunders et al.
6,253,588 B1 7/2001 Rashid et al.
6,810,709 B2 * 11/2004 Hammar et al. ..... 72/342.7
7,159,427 B2 * 1/2007 Schroth et al. ..... 72/60
7,178,376 B2 * 2/2007 Bergue et al. ..... 72/342.8
2005/0199031 A1 * 9/2005 Hammar ..... 72/342.8
2008/0149503 A1 * 6/2008 Pandori ..... 206/223

* cited by examiner

*Primary Examiner*—Dana Ross
*Assistant Examiner*—Debra M Sullivan
(74) *Attorney, Agent, or Firm*—Quinn Law Group, PLLC

(57) ABSTRACT

Metal forming apparatuses provide enhanced thermal efficiency by reducing thermal conduction from a forming tool to a shield. In one embodiment, a shield extends between a tool and a mounting plate, and is in conductive heat transfer relationship with the tool via a plurality of protuberances. In another embodiment, a shield extends between a tool and a mounting plate, and thermally insulating material separates the tool and the shield.

14 Claims, 2 Drawing Sheets

METAL FORMING APPARATUS

TECHNICAL FIELD

This invention relates to metal forming apparatuses characterized by shields between a mounting plate and a tool.

BACKGROUND OF THE INVENTION

Metal forming tools used in superplastic forming (SPF) and quick plastic forming (QPF) typically include a first portion that defines a gas pressure chamber and a second portion that defines a forming surface. During operation of an SPF or QPF forming tool, a metal blank is placed between the first and second portions of the forming tool such that a first side of the blank is in fluid communication with the chamber and a second side of the blank faces the forming surface.

Fluid pressure is introduced into the chamber, which acts on the first side of the metal blank, causing the blank to deform so that the second side contacts, and assumes the shape of, the forming surface. The tool is maintained at an elevated operating temperature sufficient for plastic deformation of the blank at the forming pressure, typically between 825° F. and 950° F.

SUMMARY OF THE INVENTION

It has been surprisingly discovered that, for a typical insulated QPF or SPF forming tool, approximately fifty percent of heat loss is through side shields when the tool is closed. Metal forming apparatuses are provided herein that significantly reduce heat loss via shields than prior art metal forming apparatuses, and, accordingly, provide significantly greater thermal efficiency and lower operating costs than prior art metal forming apparatuses. The metal forming apparatuses provided herein enable this significant reduction in heat loss with shields comprised of metal, which, although heat conductive, is less expensive and more durable than more thermally insulating materials such as ceramics. Furthermore, by reducing heat loss through shields, a more uniform tool temperature is achievable.

In an exemplary embodiment, a metal forming apparatus includes a metal forming tool, a mounting plate to which the metal forming tool is operatively connected, a plurality of protuberances that define open spaces therebetween, and a shield extending between the plate and the tool. The shield is in heat transfer relationship with the metal forming tool via the protuberances.

In another exemplary embodiment, a metal forming apparatus includes a metal forming tool, a plate to which the metal forming tool is operatively connected, a shield extending between the forming tool and the plate, and thermally insulating material separating the shield and the forming tool.

The above features and advantages and other features and advantages of the present invention are readily apparent from the following detailed description of the best modes for carrying out the invention when taken in connection with the accompanying drawings.

DESCRIPTION OF THE PREFERRED EMBODIMENTS

Figure 1:
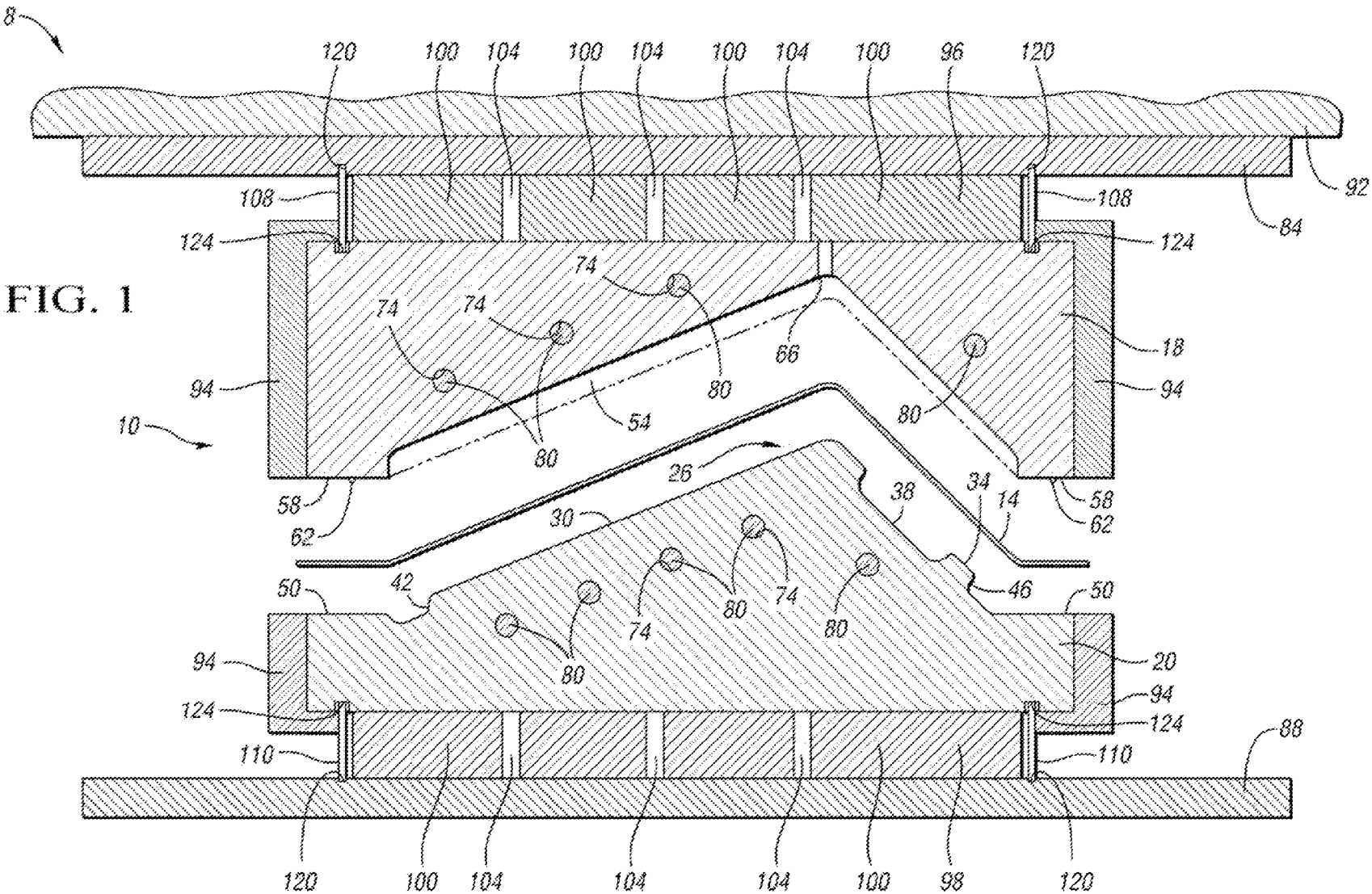
FIG. 1 is a schematic, cross-sectional side view of a metal forming apparatus taken along a vertical plane.

Referring to FIG. 1, a metal forming apparatus 8 is schematically depicted. The metal forming apparatus 8 includes a metal forming tool 10 for stretch forming a metal blank 14. The forming tool 10 includes an upper portion 18 and a lower portion 20. The forming tool 10 depicted is configured to form the blank 14 into a decklid outer panel (not shown); however, a forming tool may be configured to form a blank or other metal piece into any form within the scope of the claimed invention. The blank 14 is depicted with bends or curves; however, those skilled in the art will recognize that other blank configurations may be employed. The blank 14 is formed from a flat, cleaned and lubricated sheet blank that is heated with a preheater (not shown) that heats the blank to a suitable forming temperature.

The lower portion 20 defines a complex forming surface 26 that defines the back side of the decklid outer panel. The forming surface 26 includes a forming surface portion 30 that defines a horizontal portion of the decklid. Another portion 34 of the forming surface 26 forms a vertical portion of the decklid. Still another portion 38 of the forming surface 26 forms a license plate recess. Other portions 42, 46 of the forming surface 26 form flanges at the forward edge of the horizontal portion of the decklid and the bottom of the vertical portion. The periphery 50 of the lower portion 20 has a surface for clamping and sealing the peripheral portion of the blank 14.

The upper portion 18 is complementary in shape to the lower portion 20 and is provided with a shallow cavity 54 that forms a chamber for the introduction of a high pressure working gas, e.g., air, nitrogen or argon, against the back side of the blank 14. The periphery 58 of the upper portion 18 incorporates a sealing bead 62 that is adapted to engage the perimeter of the blank 14 and to seal against working gas pressure loss when the upper portion 18 is closed against the blank 14 and lower portion 20. The upper portion 18 also includes a working gas inlet 66 to admit fluid pressure to the gas pressure chamber 54 and against the back side of the blank 14.

The lower portion 20 defines a plurality of passageways (not shown) that extend from the forming surface 26 to an exhaust port (not shown) to enable air or other entrapped gas to escape from below the blank 14 so that the blank can subsequently be stretched into strict conformance with the shaping surface 26 of the lower portion 20 of the forming tool 10.

The upper and lower portions 18, 20 each define a plurality of cavities 74 in which heating elements 80 are disposed. In the embodiment depicted, the cavities 74 are bores formed through the tool portions 18, 20. The heating elements 80 are preferably electrical resistance heating elements, and are provided to maintain the tool 10 at the desired operating temperature of about 825° F. to 950° F. The placement of the heating elements is preferably configured to ensure uniformity of the temperature throughout the tool 10 to prevent warping during tool heat-up and at the operating temperature. It should be noted that the heating elements 80 preferably contact the entire circumference of the cavities 74 in order to maximize heat transfer from the heating elements 80 to the tool 10.

The upper and lower portions 18, 20 of the forming tool 10 are preferably constructed of a solid material to maximize the heat transfer from the plurality of heating elements 80 through the forming tool 10. The portions 18, 20 of the forming tool 10 may be constructed of a tool grade steel that exhibits durability at the forming temperatures of a superplastic or quick plastic forming operation. Preferably, the forming tool detail is constructed of AISI P20 steel that is readily available in large billets to accommodate a large forming tool. The initial forged steel billet is machined to form a curved detail specific to the part being produced by the heated metal forming tool 10. AISI P20 steel may be readily weld repaired and refinished, as opposed to higher carbon material compositions, which are more difficult to weld repair and refinish.

The upper portion 18 is attached to an upper mounting plate 84 with fasteners (not shown). The lower portion 20 is attached to a lower mounting plate 88 with fasteners (not shown). The upper mounting plate 84 is attached to a press 92 for selectively opening and closing the metal forming tool 10, i.e., for selectively moving the upper portion 18 between open and closed positions with respect to the lower portion 20 of the forming tool 10, as understood by those skilled in the art. The mounting plates 84, 88 are preferably formed of plate steels, such as ASTM A36 steel, or AISI P20 steel, depending on the load carrying requirements. The fasteners used to connect the upper and lower portions 18, 20 to the mounting plates 84, 88 are preferably formed of heat resistant alloys, such as RA330 or other suitable heat resistant and load bearing alloys.

The metal forming apparatus 8 includes insulation to minimize heat loss from the tool 10, and thereby minimize the energy supplied to the heating elements 80 in order to maintain the tool 10 at elevated operating temperatures. Load-face insulation 96 is positioned between the upper portion 18 of the tool 10 and the upper mounting plate 84. The load-face insulation 96 includes a combination of load bearing insulation members 104 and non-load bearing insulation 100. The load bearing insulation members 104 of load-face insulation 96 are spaced from each other, and each of the members 104 of load-face insulation 96 contacts the upper mounting plate 84 and the upper portion 18 of the tool 10 to transfer loads therebetween. Non-load bearing insulation 100 fills the spaces between the load bearing insulation members 104 of load-face insulation 96.

Similarly, load-face insulation 98 is positioned between the lower portion 20 of the tool 10 and the lower mounting plate 88. The load-face insulation 98 includes a combination of load bearing insulation members 104 and non-load bearing insulation 100. The load bearing insulation members 104 of load-face insulation 98 are spaced from each other, and each of the members 104 of load-face insulation 98 contacts the lower mounting plate 88 and the lower portion 20 of the tool 10 to transfer loads therebetween. Non-load bearing insulation 100 fills the spaces between the load bearing insulation members 104 of load-face insulation 98.

Those skilled in the art will recognize a variety of materials that may be used to form the load bearing insulation members 104, such as high load bearing ceramics, high load bearing composites, INCONEL alloys, and various austenitic steels. In a preferred embodiment, the load bearing insulation members 104 are austenitic steel posts. The non-load bearing insulation is preferably a blanket insulation that is capable of withstanding the elevated temperature of the forming tool. Those skilled in the art will recognize a variety of materials that may be used to form the non-load bearing insulation 100 within the scope of the claimed invention. An exemplary blanket insulation is Cer-wool RT commercially available from Vesuvius, USA. The load-face insulation 96, 98 isolates the high-temperature forming tool portions 18, 20 from the mounting plates 84, 88 to maintain a high temperature within the forming tool 10, as well as to maintain a lower ambient temperature on the outside of the forming tool 10. Mounting plates 84, 88 are preferably water-cooled.

The metal forming apparatus 8 also includes insulation surrounding its periphery. More specifically, insulating members 94 are attached to the tool 10 to cover a respective vertical peripheral surface of the tool 10.

The metal forming apparatus 8 further includes side shields 108, 110 that function to protect and contain the load-face insulation 96, 98. Side shields 108 extend from the upper tool portion 18 to the upper mounting plate 84, and cooperate with the upper tool portion 18 and the upper mounting plate 84 to enclose the load-face insulation 96. Similarly, side shields 110 extend from the lower tool portion 20 to the lower mounting plate 88, and cooperate with the lower tool portion 20 and the lower mounting plate 88 to enclose the load-face insulation 98.

Figure 2:
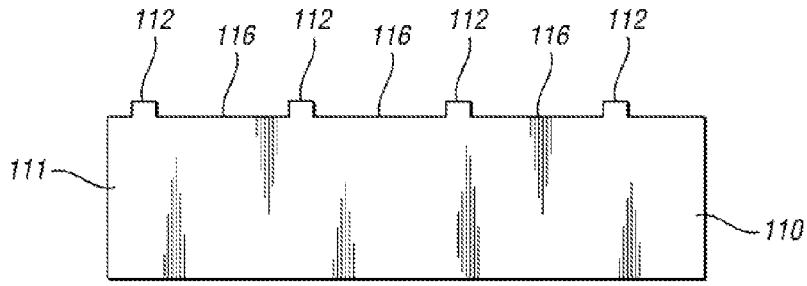
FIG. 2 is a schematic side view of a shield of the metal forming apparatus of FIG. 1.

Referring to FIG. 2, wherein like reference numbers refer to like components from FIG. 1, a side shield 110 is schematically depicted. The shield 110 is characterized by a rectangular portion 111 and a plurality of protuberances, namely tabs 112, extending from the rectangular portion 111. The shield 110 in the embodiment depicted is formed from a metal sheet, preferably stainless steel, and is approximately 0.062 inches thick. The tabs 112 are spaced apart from one another and define open spaces 116 therebetween. The rectangular portion 111 further defines the open spaces 116.

Figure 3A:
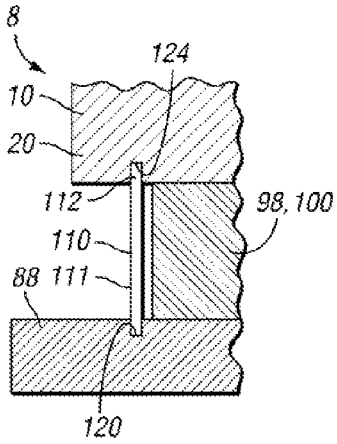
FIG. 3*a* a schematic, cross-sectional, side view of a portion of the metal forming apparatus of FIG. 1 taken along the vertical plane of FIG. 1.
Figure 3B:
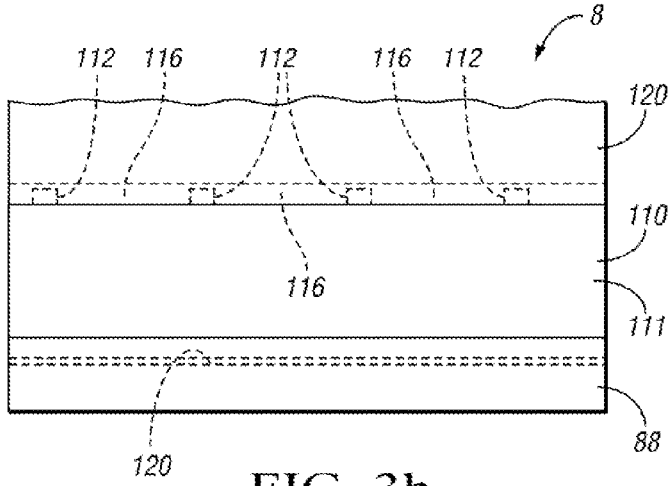
FIG. 3*b* is another schematic, cross-sectional, side view of a portion of the metal forming apparatus of FIG. 1 taken along a vertical plane perpendicular to the vertical plane of FIG. 1.

Referring to FIGS. 3*a* and 3*b*, wherein like reference numbers refer to like components from FIGS. 1 and 2, shield 110 is depicted installed in tool 10, and more particularly, between tool portion 20 and lower mounting plate 88 and adjacent load-bearing insulation 98. Lower mounting plate 88 defines a slot 120 into which part of the rectangular portion 111 extends to secure the shield 110 with respect to the lower mounting plate 88. The lower tool portion 20 defines slot 124 into which the tabs 112 and the open spaces 116 extend to secure the shield 110 with respect to the forming tool 10. The tabs 112 contact the tool 10 inside slot 124, and thus the shield 108 is in conductive heat transfer relationship with the tool 10 via the tabs 112. In the context of the claimed invention, two objects are in "conductive heat transfer relationship" with one another if heat is conductable through solid material therebetween. Thus, although in a preferred embodiment the shield 110 is in conductive heat transfer relationship with the tool 10 through the direct contact between the tabs 112 and the tool, it is within the scope of the claimed invention for the shield to be in conductive heat transfer relationship with the tool without direct contact between the tabs and the tool For example, the tabs 112 may be in conductive heat transfer relationship with the tool 10 through an intermediate member (not shown) that is in contact with both the tool 10 and the tabs 112.

The contact area between shield 110 and tool 10 is reduced compared to a rectangular shield in which open spaces 116 are not present, i.e., in which the space occupied by open spaces 116 is instead occupied by solid material in contact with the hot forming tool 10. In an exemplary embodiment of shield 110, the open spaces 116 replace ninety percent of the material in a rectangular prior art shield that would contact the tool; accordingly, the amount of contact area between the shield 110 and the tool 10 is reduced by ninety percent compared to the rectangular prior art shield. A ninety percent reduction in contact area between the tool 10 and the shield 110 is expected to achieve a sixty percent reduction in heat transfer from the tool 10 to the surrounding environment via the shield 110. In a preferred embodiment, the tabs 112 and the open spaces 116 therebetween, but not any part of the rectangular portion 111, extend into the slot 124 so that the contact area between the hot tool 10 and the shield 110 is limited to the tabs 112.

It should be noted that the shields shown at 108 in FIG. 1 are substantially identical to the shield depicted at 110; however, shield 108 is oriented such that the tabs 112 extend downward to contact the the upper portion 18 of tool 10 in a slot 124, whereas the tabs 112 of shield 110 extend upward to contact the lower portion 20 of the tool 10.

Slots 124 are in conductive heat transfer relationship with the the cavities 74. More specifically, solid metal material between the cavities 74 and the slots 124 provides a conductive heat path between the cavities 74 and the slots 124.

Figure 4:
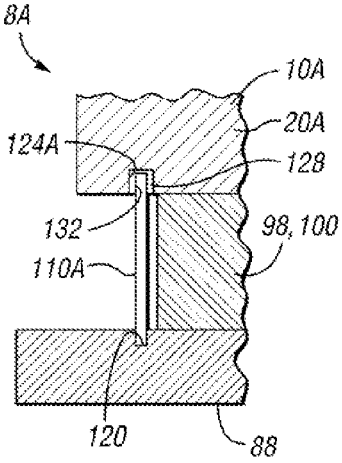
FIG. 4 is a schematic, cross-sectional side view of a portion of an alternative metal forming apparatus in accordance with the claimed invention.

Referring to FIG. 4, wherein like reference numbers refer to like components from FIGS. 1-3*b*, a portion of an alternative metal forming apparatus 8A is schematically depicted. The metal forming apparatus 8A includes metal forming tool 10A, with forming tool portion 20A. Tool 10A is identical to tool 10 of FIG. 1 except that the slots 124A defined by the tool portions are wider than the slots 124 of FIG. 1. Thermally insulating material 128, i.e., material having a thermal conductivity less than that of the tool portion 20A and the shield 110A, is disposed within slot 124A and contacts the tool 10A. The thermally insulating material 128 defines a slot 132 which, in the embodiment depicted, is wholly located within slot 124A. Those skilled in the art will recognize a variety of thermally insulating materials, and forms of materials, that may be employed within the scope of the claimed invention. For example, thermally insulating material 128 may be ceramic, and may be in the cloth form, solid block form, a "mud"-like material, etc.

Shield 110A is rectangular and preferably formed of austenitic stainless steel. A first portion of shield 110A extends into slot 120 in the mounting plate 88, and a second portion of shield 110A extends into slot 132 in the thermally insulating material 128. Accordingly, the thermally insulating material 128 separates the shield 110A and the tool 110A, thereby reducing the heat transfer from the tool 10A to the shield 110A and, correspondingly, providing a significant decrease in the overall amount of heat loss from the tool 10A. It should be noted that, although shield 110A is rectangular in the embodiment depicted in FIG. 4, the shield 110A may include tabs 112 or other protrusions extending into slot 132 within the scope of the claimed invention. In a preferred embodiment, the shield 110A is in conductive heat transfer relationship with the tool 10A only through the thermally insulating material 128.

Figure 5:
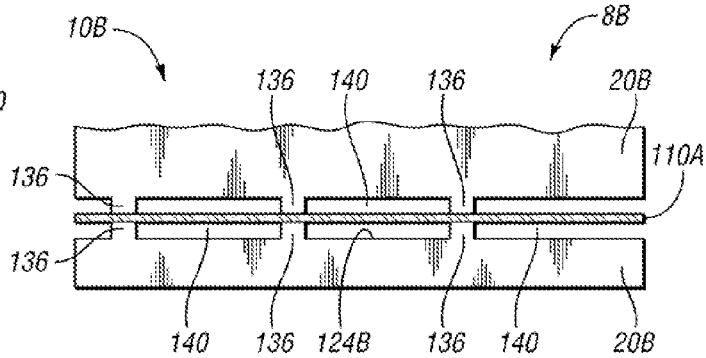
FIG. 5 is a schematic cross-sectional view taken along a horizontal plane of a portion of another alternative metal forming apparatus in accordance with the claimed invention.

FIG. 5, wherein like reference numbers refer to like components from FIGS. 1-4, schematically depicts a portion of yet another alternative metal forming apparatus 8B. The metal forming apparatus 8B is substantially identical to the metal forming apparatus 8 of FIG. 1, and the metal forming tool 10B is substantially identical to the metal forming tool 10 of FIG. 1, except for the shape of the slots 124B defined by the metal forming tool 10B. Referring to FIG. 5, lower tool portion 20B of tool 10B defines slot 124B. The lower tool portion 20B also defines a plurality of protuberances 136 that extend into the slot 124B. The protuberances 136 defines a plurality of open spaces 140 therebetween. The rectangular, metal shield 110A extends into the slot 124B so that the shield 110A contacts the protuberances 136. Accordingly, the shield 110A is in conductive heat transfer relationship with the tool 10B via the protuberances 136. The open spaces 140 separate the shield 110A and the tool 10B such that the contact area between the tool 10B and the shield 110A is limited to the protuberances 136, thereby reducing heat transfer from the tool 10B to the shield 110A compared to a tool that contacts the shield along the entire length of the slot 124B.

The protuberances 112, 136 in the embodiments of FIGS. 2 and 5 are defined by a shield 110 or a tool 20B, respectively. However, it should be noted that protuberances may be defined by one or more other members within the scope of the claimed invention. For example, protuberances 136 may be defined by separate members inserted into slot 124B, such as blocks, clips, etc. Protuberances 112, 136 are also depicted as being generally rectangular; however, a protuberance may be characterized by a variety of shapes, such as rounded, triangular, etc., within the scope of the claimed invention.

While the best modes for carrying out the invention have been described in detail, those familiar with the art to which this invention relates will recognize various alternative designs and embodiments for practicing the invention within the scope of the appended claims.

The invention claimed is:

1. A metal forming apparatus comprising:

a metal forming tool;

a mounting plate to which the metal forming tool is operatively connected;

a plurality of protuberances that are spaced apart from one another such that open spaces are defined between the protuberances; and a shield extending between the mounting plate and the forming tool and being in conductive heat transfer relationship with the tool via said protuberances;

wherein said metal forming tool defines said plurality of protuberances;

wherein said metal forming tool defines a slot; wherein said protuberances extend into said slot; and wherein said shield extends into said slot.

2. The metal forming apparatus of claim 1, wherein said forming tool defines at least one cavity; and wherein the metal forming apparatus further comprises at least one heating element being at least partially disposed within said at least one cavity.

3. The metal forming apparatus of claim 2, wherein said tool is comprised of metallic material such that said at least one cavity and said protuberances are in conductive heat transfer relationship with one another via said metallic material.

4. The metal forming apparatus of claim 3, wherein said shield is comprised of metal.

5. The metal forming apparatus of claim 2, wherein said at least one heating element is an electrical resistance heating element.

6. The metal forming apparatus of claim 1, wherein said metal forming tool defines a forming surface and a gas pressure chamber.

7. The metal forming apparatus of claim 1, further comprising insulation between said forming tool and said mounting plate.

8. A metal forming apparatus comprising:

a metal forming tool;

a plate to which said metal forming tool is operatively connected;

a shield extending between the forming tool and the plate; and thermally insulating material separating the shield and the forming tool;

wherein the shield is in conductive heat transfer relationship with the metal forming tool only through the thermally insulating material;

wherein the metal forming tool defines a first slot in which the thermally insulating material is at least partially located; wherein said thermally insulating material defines a second slot; and wherein said shield extends into the second slot.

9. The metal forming apparatus of claim 8, wherein said forming tool defines at least one cavity; and wherein the metal forming apparatus further comprises at least one heating element being at least partially disposed within said at least one cavity.

10. The metal forming apparatus of claim 9, wherein said tool is comprised of metallic material such that said at least one cavity and said thermally insulating material are in conductive heat transfer relationship with one another via said metallic material.

11. The metal forming apparatus of claim 10, wherein said shield is comprised of metal.

12. The metal forming apparatus of claim 8, further comprising insulation between said forming tool and said mounting plate.

13. The metal forming apparatus of claim 8, wherein said forming tool defines a forming surface and a gas pressure chamber.

14. A metal forming apparatus comprising:

a metal forming tool defining a forming surface, a gas pressure chamber, and a slot;

a mounting plate to which the metal forming tool is operatively connected;

insulation between said metal forming tool and said mounting plate; and a shield connected to said metal forming tool and said mounting plate to at least partially enclose the insulation; said shield defining a plurality of tabs defining open spaces therebetween; said tabs and open spaces being positioned within said slot.

* * * * *